US009131302B2

(12) United States Patent
Williams et al.

(10) Patent No.: US 9,131,302 B2
(45) Date of Patent: Sep. 8, 2015

(54) SPEAKER TEMPERATURE CONTROL USING SPEAKER TEMPERATURE AND SPEAKER IMPEDANCE ESTIMATES

(71) Applicant: Apple Inc., Cupertino, CA (US)

(72) Inventors: Joseph M. Williams, Morgan Hill, CA (US); Andrew P. Bright, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 270 days.

(21) Appl. No.: 13/629,354

(22) Filed: Sep. 27, 2012

(65) Prior Publication Data

US 2013/0329898 A1 Dec. 12, 2013

Related U.S. Application Data

(60) Provisional application No. 61/658,246, filed on Jun. 11, 2012.

(51) Int. Cl.
*H04R 29/00* (2006.01)
*H04R 9/02* (2006.01)
*H04R 3/00* (2006.01)

(52) U.S. Cl.
CPC ..... *H04R 9/022* (2013.01); *H04R 29/003* (2013.01); *H04R 3/007* (2013.01)

(58) Field of Classification Search
CPC ..... H03F 1/52; H04R 9/022; H04R 3/007; H04R 3/00; H04R 29/003; H04R 3/04; H03G 3/301; H03G 11/008; H03G 7/007; H03G 7/002
USPC ..... 381/55, 59, 17, 58, 397, 318, 99, 100, 381/103, 106, 108, 164, 372, 394; 327/72; 330/282, 292, 284, 76, 86, 87, 92, 94, 330/95, 105, 110, 143, 144, 189, 196; 318/693, 73, 96, 133, 784, 792, 814, 318/821, 824, 249, 250, 380, 508, 509, 511, 318/533, 534; 361/188; 73/574, 589; 700/293
See application file for complete search history.

(56) References Cited

U.S. PATENT DOCUMENTS 6,940,981 B2 9/2005 Neunaber
7,447,318 B2 11/2008 Button et al.
8,259,953 B2 9/2012 Jensen et al.

(Continued)

OTHER PUBLICATIONS

"Real-Time Voice-Coil Temperature and Cone Displacement Control of Loudspeakers", AES E-Library, Jun. 9, 2012, Internet at: http://www.aes.org/e-lib/browse.cfm?elib=12906, (1 page).

*Primary Examiner* — Vivian Chin
*Assistant Examiner* — Ubachukwu Odunukwe
(74) *Attorney, Agent, or Firm* — Blakely, Sokoloff, Taylor & Zafman LLP

(57) ABSTRACT

A thermal control module computes an estimate of a temperature of a speaker, based on an audio signal that is driving the speaker, and computes a gain that is applied to attenuate the audio signal to prevent overheating of the speaker. Thermal control module computes an adapted impedance, being an estimate of the speaker's impedance including its DC resistance, and uses it to compute the temperature estimate. The adapted impedance is obtained from a normal adaptation process when a measured voltage of the speaker is above a threshold, and a decay process when the measured voltage is below the threshold. Other embodiments are also described.

19 Claims, 5 Drawing Sheets

(56) References Cited

U.S. PATENT DOCUMENTS

2002/0118841 A1* 8/2002 Button et al. ..... 381/55
2009/0257599 A1* 10/2009 Sand Jensen et al. ..... 381/55
2012/0020488 A1* 1/2012 Huijser et al. ..... 381/59

* cited by examiner

SPEAKER TEMPERATURE CONTROL USING SPEAKER TEMPERATURE AND SPEAKER IMPEDANCE ESTIMATES

This applications claims the benefit of the earlier filing date of provisional application No. 61/658,246 filed Jun. 11, 2012.

An embodiment of the invention generally relates to automatic techniques for controlling the gain or attenuation that is applied to an audio signal, which is driving a speaker, so as to prevent overheating of the speaker, and more particularly to techniques that use a speaker impedance model to compute an estimate of the speaker's temperature. Other embodiments are also described.

BACKGROUND

Speakers have relatively low efficiency in the conversion of an electrical audio input signal into mechanical or acoustical output (sound waves). Most of the input energy is used to heat a voice coil that moves a diaphragm to produce the sound waves. Although some materials may operate at relatively high temperatures, including certain permanent magnet materials that are used in the magnet system of the speaker, excessive temperature can result in damaging the speaker. In addition, certain characteristics of audio signals can also lead to increased or even excessive temperature in a speaker. When a speaker is producing a high volume of sound for an extended amount of time, the amount of power being dissipated may rise to a sufficiently high level that causes the speaker to rise to very high temperatures thereby putting the speaker at risk for damage by overheating. Typically, the risk of heat damage rises when continuously high sound levels are being produced, for a fairly long period of time, rather than in response to sharp spikes. It is possible to limit the amplitude of the audio signal that is driving the speaker, namely by attenuating the signal (or reducing the gain applied to it), based on, for instance, the speaker's nominal power rating and impedance. A simple RMS voltage limiter, however, neglects the fact that a speaker can usually handle large RMS voltages for sufficiently short periods of time, so that approach is likely to provide too much limiting. Another approach is to monitor the voltage and current that is being delivered by the power amplifier to the speaker. In yet another solution, a detailed thermal model of a speaker is defined, and is then used to continuously calculate an estimate of the temperature of, for instance, the speaker voice coil, as the input audio signal is driving the voice coil.

The thermal model approach may track the voltage that is being applied to the terminals of a speaker, and then uses the measured voltage to calculate or predict the instantaneous temperature of, for instance, the voice coil. As the estimated temperature varies and crosses predefined thresholds, a thermal gain control algorithm responds by continuously varying the gain (attenuation) that is applied to the audio signal (that drives the speaker), in order to prevent the speaker from overheating. The thermal model uses many input parameters to compute the estimated temperature.

SUMMARY

A temperature estimate can be computed by a speaker thermal model that has, as one of its input parameters, an estimate or prediction of the speaker's impedance, and in particular its DC resistance. It has been discovered that this temperature estimate may start to become unreliable or unstable, when the measured output power at the speaker (e.g., via audio power amplifier or speaker voltage and current measurements) suddenly drops to low levels, either because the content suddenly becomes quiet or the user lowers the volume significantly. As a result, the thermal gain control becomes unreliable. Further study has revealed that a cause of this instability in the thermal model (or its failure to converge to a close enough estimate of the true speaker temperature) may be a sudden drop in the estimated DC resistance, which is precipitated by the sudden reduction in the measured speaker power or voltage.

An embodiment of the invention is a method for controlling or limiting a temperature of a speaker, as well as a hardware apparatus for doing so. The method computes a gain as a function of a temperature estimate for the speaker; the audio signal is attenuated in accordance with the gain. Now, the temperature estimate is computed using a thermal model of the speaker. To do so, the thermal model uses, as its inputs, the audio signal and an impedance estimate for the speaker. The speaker impedance estimate is an estimate of an electrical impedance of the speaker, and in particular its DC resistance, which changes substantially as a function of temperature (as the speaker is being driven).

The speaker impedance estimate may be computed as follows. The voltage of the speaker is monitored while the speaker is being driven by the audio signal. While the monitored speaker voltage is greater than a threshold, the impedance estimate is computed using a first methodology. The first methodology results in the computed impedance estimate responding quickly to changes in the monitored voltage. But when the monitored speaker voltage drops below the threshold, the impedance estimate starts to be computed using a second methodology. The second methodology results in the computed impedance estimate responding slowly to changes in the monitored voltage. Using this combination of impedance estimate in the speaker thermal model may yield a more reliable temperature estimate, which in turns allows more effective control of the speaker temperature by avoiding undue changes in the gain that is being applied to attenuate the audio signal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
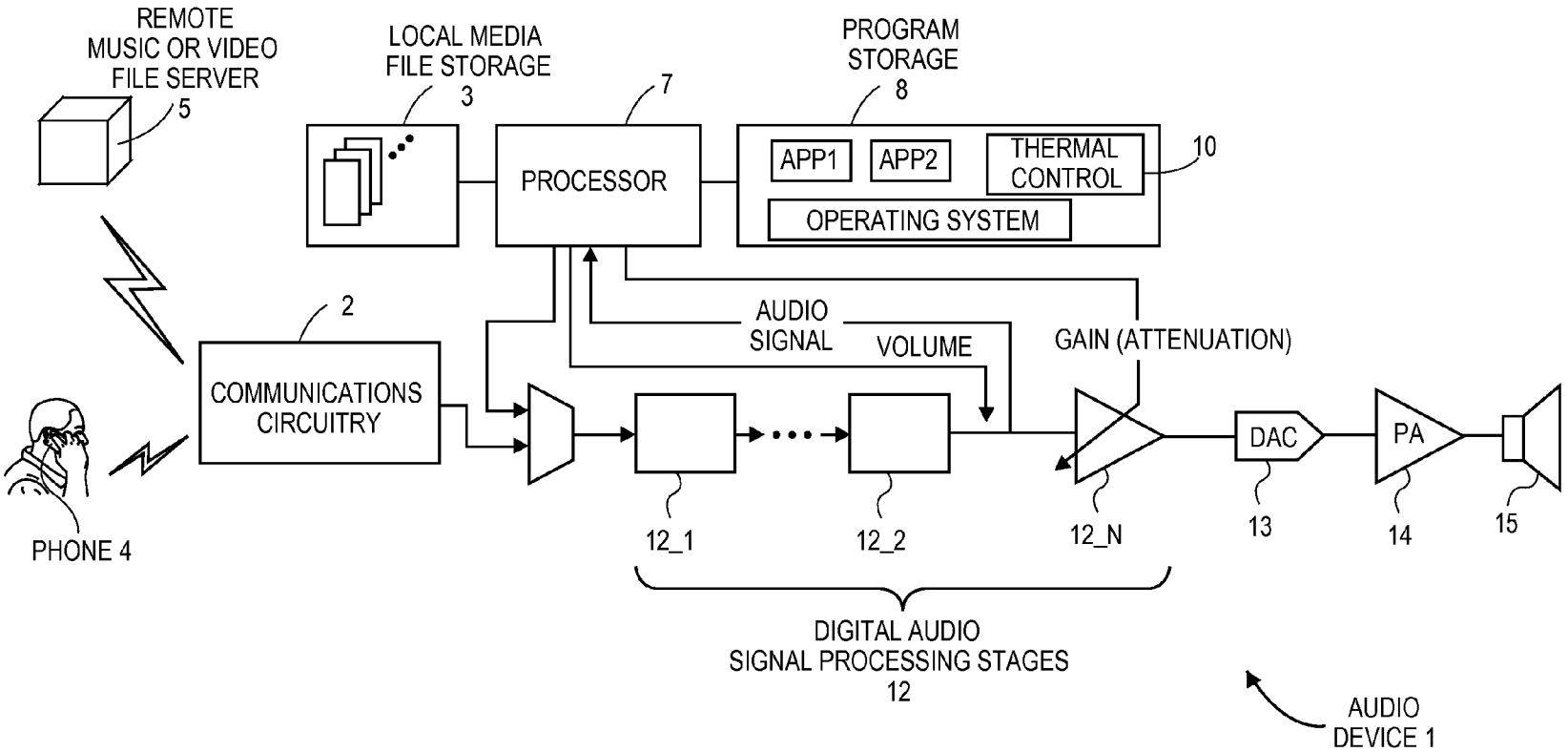
FIG. 1 is a block diagram of relevant components of an audio device in which a thermal control module for a speaker may be implemented.

FIG. 1 is a block diagram of relevant components of an audio device in which a thermal control module for a speaker may be implemented. The audio device 1 may be a consumer electronic audio output device such as a desktop computer, a notebook or laptop computer, a tablet computer, a smart phone, or an audio-video entertainment system. The source of the audio signal (that will be converted to sound through a speaker 15) may be communications circuitry 2 which receives the audio signal in the form of a downlink communications signal from a remote music or video file server 5 (e.g., a music or video stream over the Internet). The audio signal may alternatively contain speech from a phone 4 of a far-end user that is engaged in a two-way voice communications session with a near-end user (not shown) of the audio device 1. The session in that case may be generically referred to as a voice call or it may be a video call. As yet another possibility, the audio signal may be originated by a processor 7 reading a music or video file that is stored in a local media file storage 3 within a housing (not shown) of the audio device 1. The processor 7 may be programmed in accordance with an operating system and one or more application programs (e.g., app1, app2), which are stored in a program storage 8, typically also located within the housing of the audio device 1. The local media file storage 3 and program storage 8 may be implemented as machine-readable media such as non-volatile solid-state memory (e.g., flash memory, rotating magnetic disk drive, or a combination thereof). The processor 7, in this case, is also programmed in accordance with, or is to execute, instructions within a thermal control module 10. The thermal control module 10 as described below defines the operations of a process for ultimately controlling a temperature of the speaker 15 during audio playback.

The selected audio signal, which in this case is in digital form, is provided to a group of audio signal processing stages 12. Depending on the source or type of signal, the signal processing stages 12 may vary, so as to enhance the quality of the sound that is ultimately produced through the speaker 15. These stages may include one or more of the following: automatic gain control, noise reduction, equalization, acoustic echo cancellation, and compression or expansion. Most of these stages are expected to be linear and hence their order is immaterial; however, in some cases there may be a non-linear operation, such as limiting, in which case the order may be of consequence. What is depicted as the last stage is a gain/attenuation stage 12_N, which may attenuate the audio signal in any one or more frequency bands (attenuation per band or frequency bin), including possibly across the board over the entire audio band, in order to control or limit a temperature of the speaker 15. Note, however, that because the gain stage 12_N is a linear operation, it need not be in the last position shown.

Once all of the desired digital signal processing has been performed upon the discrete time sequence audio signal, including applying the current volume setting that may have been manually selected by a user of the device 1, the signal is converted into analog form by a digital-to-analog converter (DAC) 13. The resulting analog or continuous time signal is then amplified by an audio power amplifier 14. The output of the power amplifier 14 then drives the speaker 15, and in most cases a voice coil of the speaker 15, which in turn converts the audio signal into sound waves.

Figure 2:
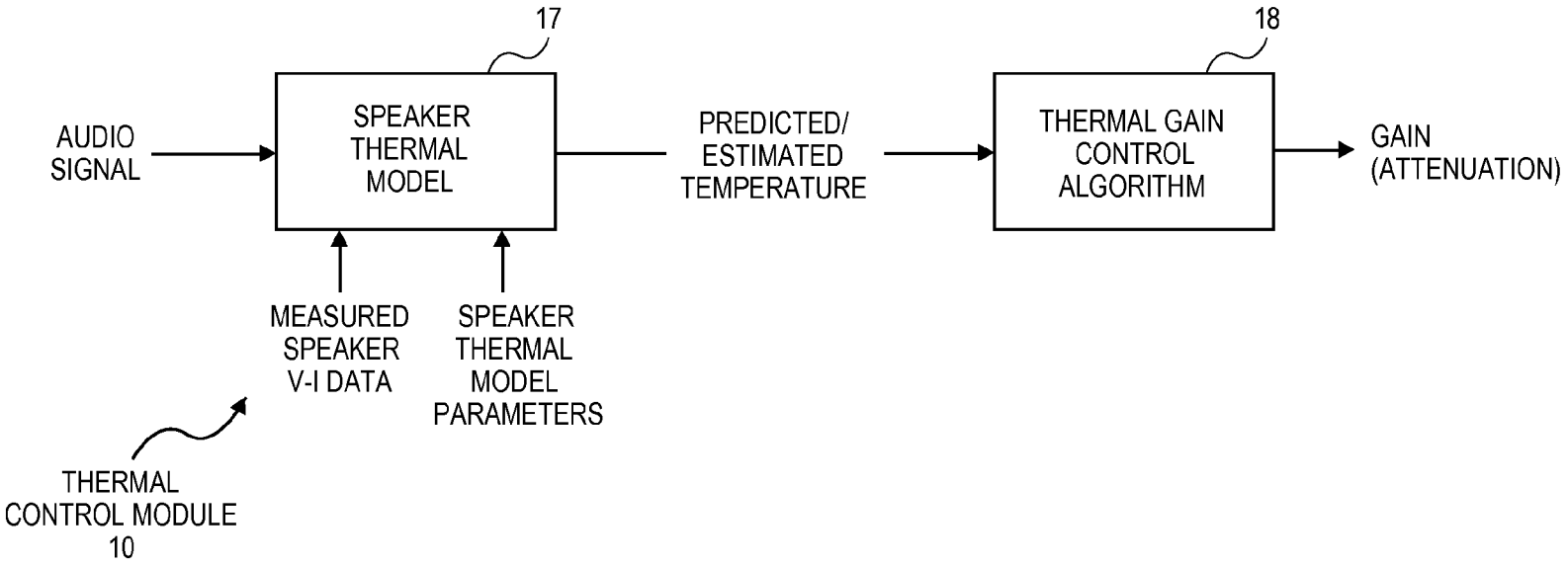
FIG. 2 is a block diagram of the thermal control module.

As explained above in the Background section, certain characteristics of audio signals, including their frequency content, as well as the volume setting, may lead to increased or even excessive temperature in the speaker 15, which may result in damaging the speaker or creating other difficulties for components that may be close to the speaker 15 (within the housing of the audio device 1). A thermal control module 10 is described here, as shown in FIG. 2, which may be able to sufficiently control or limit the temperature, while reducing unnecessary attenuation of the audio signal. The thermal control module 10 may be implemented as a programmed processor, such as the processor 7, or it may be implemented entirely as hardwired logic. The thermal control module 10 is shown in FIG. 1 as software (e.g., as part of the operating system's audio hardware abstraction layer or as lower layer firmware of a dedicated audio signal processor), but it may alternatively be viewed as a hardware component.

The thermal control module includes a speaker thermal model 17 that generates a predicted or estimated temperature of the speaker 15, based on the input digital audio sequence. The thermal model 17 has several speaker thermal model parameters that may be defined in a laboratory test setting, based on the physical characteristics and input power handling capability of the speaker 15 and the way in which the speaker 15 is housed. These parameters may take into account for example that the voice coil in the speaker 15 may heat up and cool down fairly quickly, particularly when the speaker 15 is relatively small, such as ones that are used in consumer electronic devices. The parameters used by the thermal model may include thermal time constants of the voice coil and those of the magnet system and frame, thermal resistance between the coil and the magnet system, and thermal resistance between the magnet system and the ambient air outside of the audio device 1. In some instances, the estimated temperature that is computed by the thermal model is a voice coil temperature, although a thermal model that predicts a different estimated temperature, e.g. that of the magnet system or the frame, may also be used. Note that the estimated temperature may alternatively be a combination that represents, for instance, an overall temperature for the speaker, as opposed to just that of a specific location such as the voice coil or the magnet system. The thermal model may also be fairly complex and include several state variables and electromechanical parameters, as well as thermal parameters and audio signal parameters, including the volume setting and characteristics of the power amplifier.

The output of the speaker thermal model 17 is a predicted or estimated temperature sequence $T_{est}$ whose sample rate may also be designed, based on the thermal time constants for instance, to yield the desired ultimate effect on the temperature of the speaker 15. The estimated temperature sequence is fed to a thermal gain control algorithm 18 which then, based on several predefined parameters including one or more thermal limits, will calculate a gain (attenuation) setting, e.g. a gain vector, for the gain stage 12_N (see FIG. 1).

Figure 3:
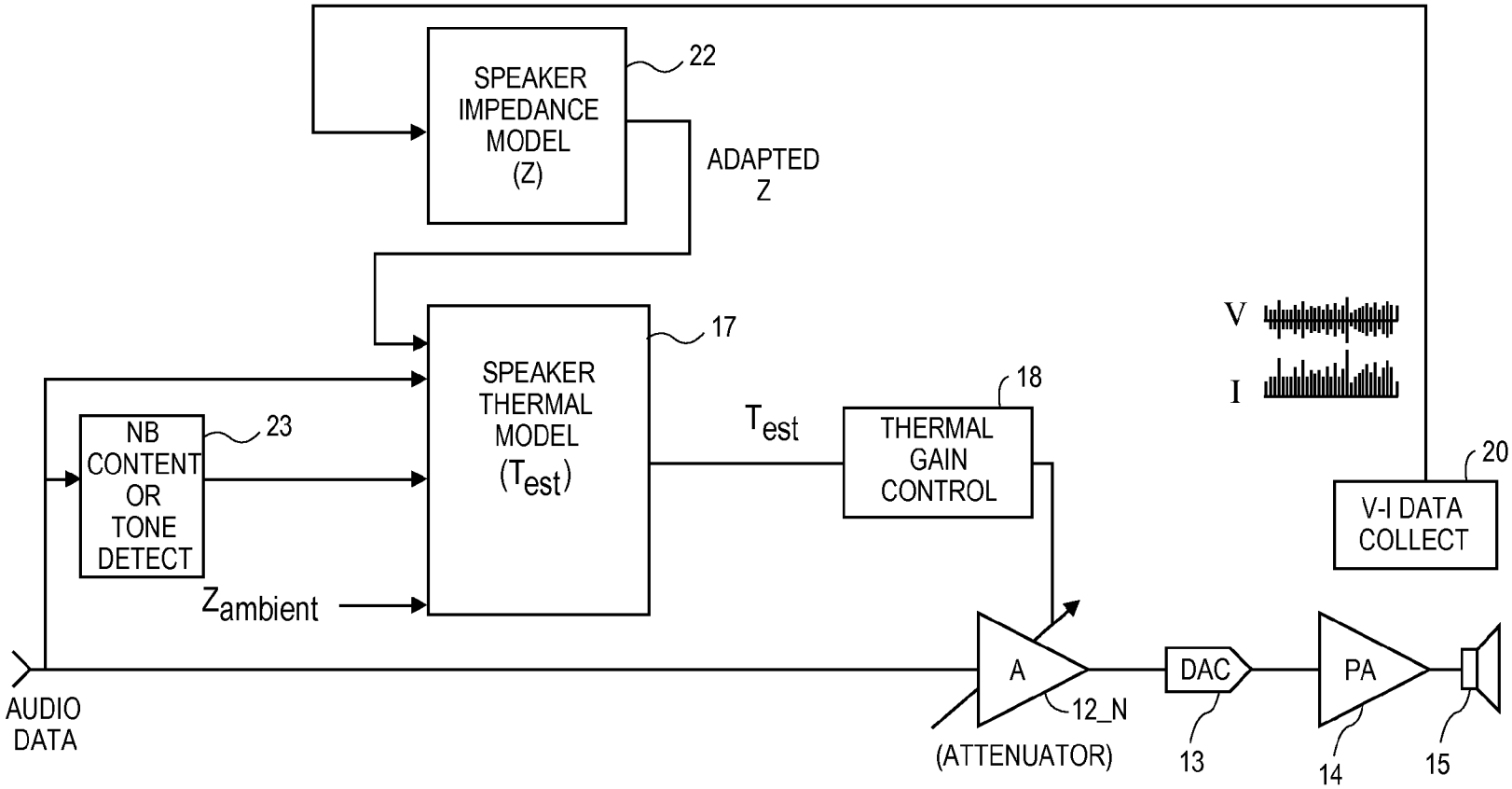
FIG. 3 shows closed loop control of the estimated speaker temperature using real-time speaker voltage and current measurements as input to a speaker impedance model.

FIG. 3 is a block diagram of a closed loop control system for managing thermal behavior of a speaker, using the thermal model 17. The thermal model 17 uses, as a further input parameter, adapted_Z, which is an estimate of the electrical input impedance of the speaker 15. The variable adapted_Z may encompass the DC resistance of the speaker's coil. It may be computed, and may be updated for each frame of speaker driver voltage and current data received from a V-I data collector 20, by a speaker impedance model (Z) 22. The latter in a sense adapts the variable based on the real-time V and I measurements, as will be described in more detail below in connection with FIG. 4 and FIG. 5.

Here it should be noted that a speaker electrical parameters monitor circuit (not shown) may be included as part of the V-I data collector 20, to monitor the actual drive voltage (V) and drive current (I) of the speaker 15. The V-I measurements may be real-time samples of the speaker's directly sensed voltage and current, as driven by the power amplifier 14 while audio data containing user content is being streamed from the audio signal processing stages 12 (see FIG. 2). Alternatively, either the voltage or the current or even both may be extrapolated or otherwise estimated values for the particular content being streamed. In both cases, discrete time sequences for V and I may be arranged in frames that are provided by the V-I data collector 20, which also serves to measure or estimate the V-I data.

The speaker impedance estimate adapted_Z is used by the speaker thermal model 17 to compute a temperature estimate $T_{est}$; the latter may also be updated on a per time frame basis. Of course, the computing of $T_{est}$ is also based on the audio data or audio content that is currently being streamed. The gain A is then computed by the thermal gain control block 18, based on $T_{est}$, and the audio signal is then attenuated in accordance with the gain A by the gain/attenuation stage 12_N.

In one embodiment, adapted_Z is computed as follows. The speaker voltage V is monitored (while the speaker 15 is being driven by the audio signal). While the monitored speaker voltage is greater than a threshold, the impedance estimate adapted_Z is computed using a first methodology that results in adapted_Z responding quickly to changes in the monitored voltage. This is depicted in the example waveforms of FIG. 4, where the waveform for adapted_Z is initially ramping up according to "normal adaptation", while the speaker voltage remains above the threshold. If the voltage increases further, the estimated impedance will rise accordingly since it is expected that the speaker will heat up more quickly as it is driven harder, and hence its electrical impedance, and in particular the DC resistance of its coil, will also rise.

Figure 4:
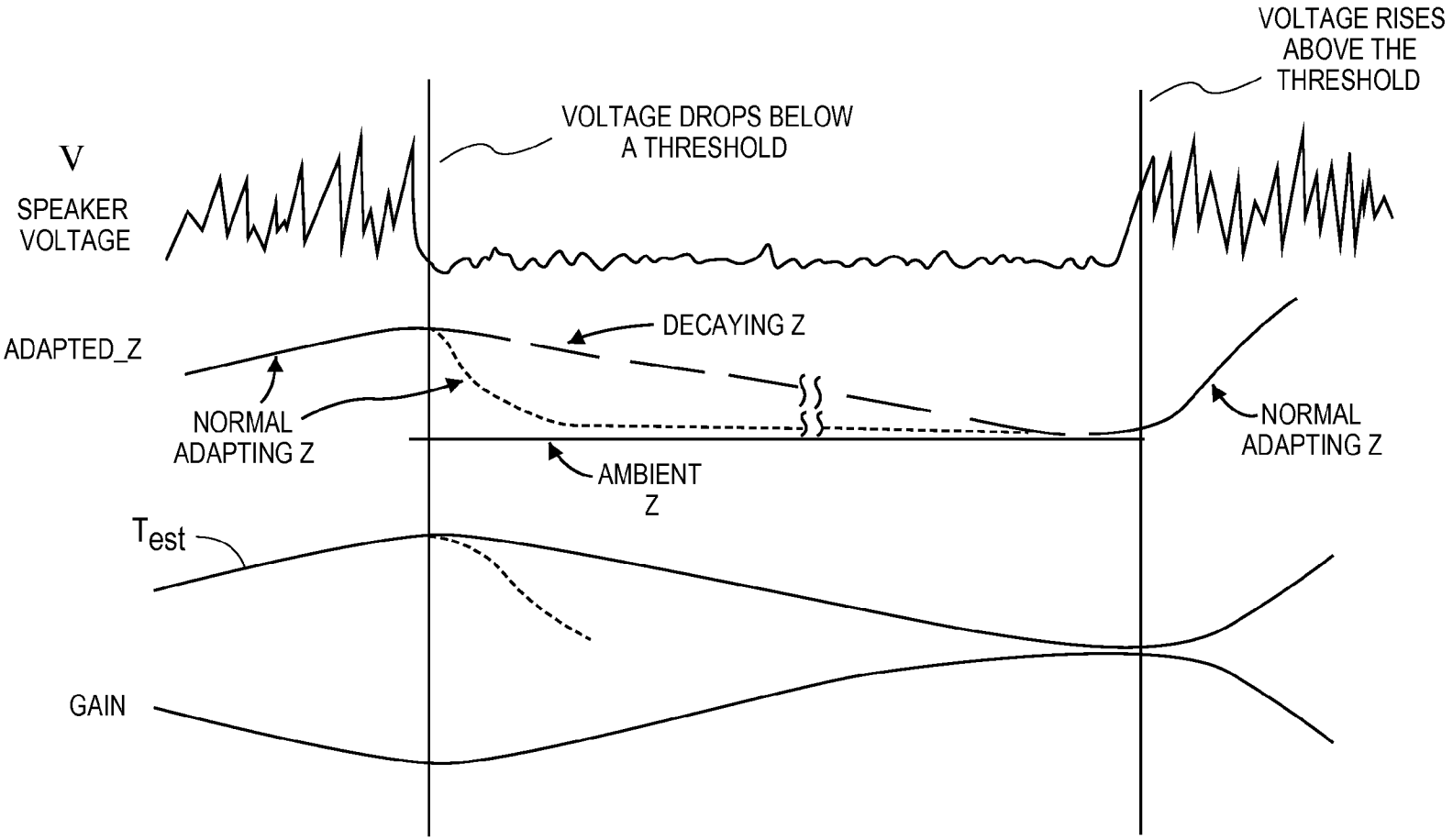
FIG. 4. shows relevant waveforms that illustrate the effect of modifying the impedance adaptation that is being computed by the speaker impedance model.

But when the monitored speaker voltage drops below the threshold as seen in FIG. 4, the normal adaptation curve that is computed by the first methodology will respond quickly, by dropping rather precipitously (as shown). However, in accordance with an embodiment of the invention, computation of the adapted_Z at that point is switched to using a second methodology that results in the computed impedance estimate responding slowly to changes in the monitored voltage. This is depicted by the decaying_Z curve, which falls much more slowly than the curve for normal adapting Z. In one embodiment, so long as the monitored speaker voltage remains below the threshold, the impedance estimate adapted_Z is computed using the second methodology. The adapted_Z may decay in this way, until it reaches an ambient impedance (ambient Z). The latter may be defined as the impedance of the speaker 15 when the speaker is at ambient temperature.

Note that an actual ambient impedance value may be measured for the speaker 15, for example during manufacturing test before a product specimen containing the speaker is shipped to customers, or during in-the-field use of the product through a self-test technique. This may be done by passing a known DC current through a pair of speaker input terminals while measuring the speaker voltage, and then computing the DC resistance using Ohm's Law. This actual ambient impedance value may be stored and used as an input parameter to the speaker thermal model 17, as shown in FIG. 3, in addition to its use by the speaker impedance model 22 to set the decay rate of the decaying_Z curve. In addition, a physical model 29 of how the speaker temperature, such as the temperature of its coil, decays once input power has dropped to very low levels, can be computed in the laboratory and stored in the audio device (see FIG. 5 described below). This physical model may then be used in the second methodology for computing the decaying_Z curve.

Another embodiment of the invention may be described as follows. So long as the monitored speaker voltage remains above a "stability" threshold, adapted_Z is computed using the first methodology, which may be described as the "normal adaptation" process for computing the impedance estimate. In this range of speaker voltage, the normal adaptation process for computing the impedance estimate may produce a reliable variable. However, once the monitored speaker voltage drops below the stability threshold and remains there, then computation of adapted_Z switches to a second methodology. An example of the second methodology is as follows. Starting from the last impedance estimate that was computed by the first methodology at about the time when the speaker voltage first dropped below the threshold, the second methodology decays the impedance estimate variable at a rate that is similar to the rate at which the speaker cools (due to its voltage having dropped).

Now, still referring to FIG. 4, when the monitored speaker voltage starts to rise above the threshold as shown, the impedance estimate adapted_Z returns to being computed using the first methodology (normal adaptation process). Here, the initial value of the normal adaptation process may be the last value of the decaying impedance estimate variable. The impedance estimate at that point starts to respond quickly to changes in the monitored voltage, and may as a result rise sharply (in accordance with the rising speaker voltage).

Figure 5:
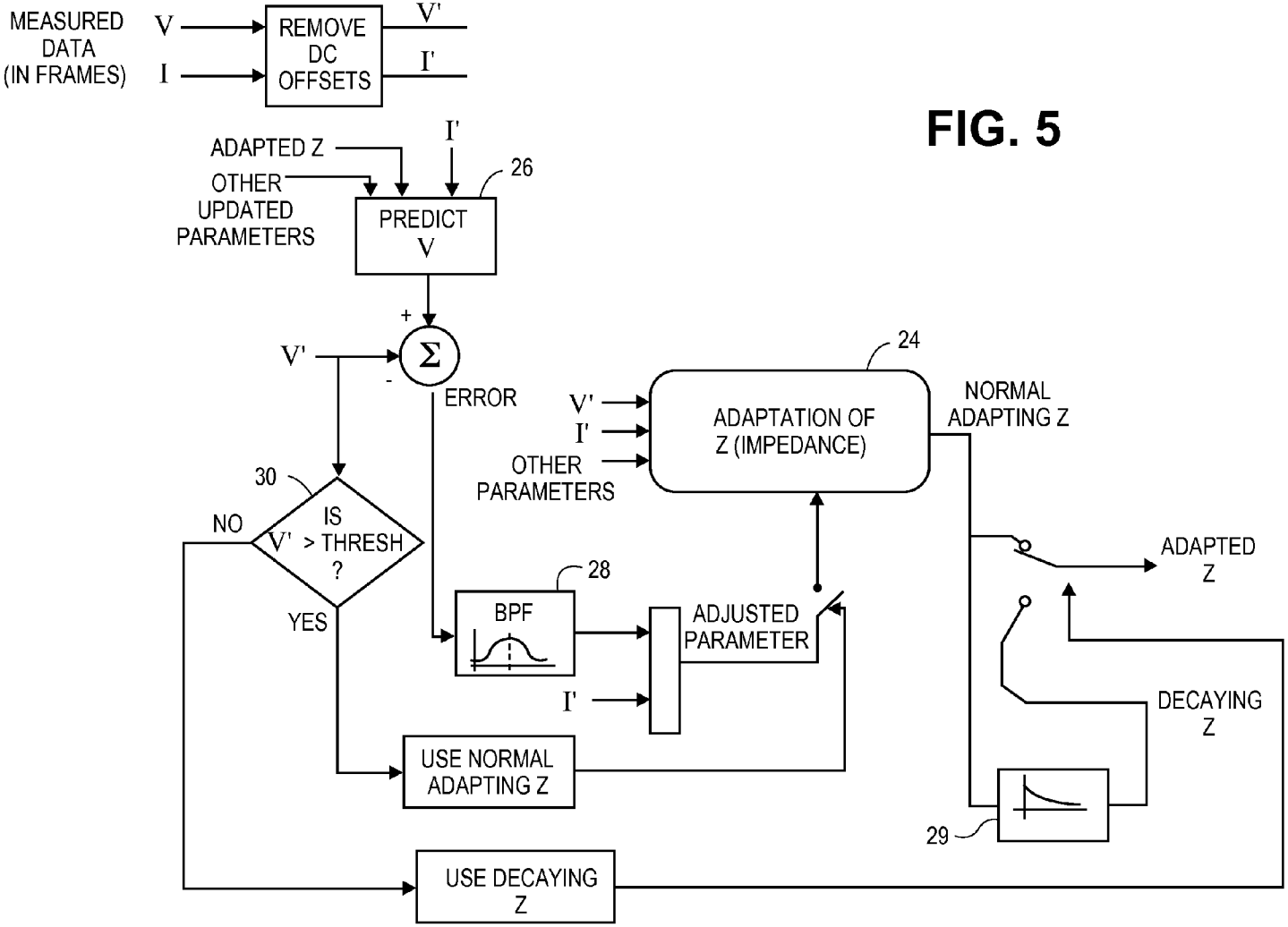
FIG. 5 is a block diagram showing details of an example speaker impedance model.

The impedance estimate adapted_Z may be computed by the first methodology (the normal adaptation process) as a function of real-time speaker voltage and current data V-I, and of other input parameters. The first methodology is depicted in FIG. 5 by a normal adaptation block 24. FIG. 5 is a more detailed block diagram of the speaker impedance model 22 (see FIG. 3). In this case, beginning with measured V-I data, the overall impedance estimation process may first remove DC offsets from the measured V-I discrete time sequences, and then operates upon the AC portion of the signals, and in particular in the frequency domain. A conversion of the V-I data into the frequency domain may therefore be assumed to have taken place, before the V'-I' data is processed by the various functions depicted in FIG. 5.

The process in FIG. 5 is adaptive in that the impedance estimate adapted_Z in so far as it encompasses the DC resistance of the speaker is an unknown variable that changes with temperature, as the speaker is being driven by essentially a random audio signal. A normal adaptation block 24 is provided that performs a process which uses the real-time instantaneous values of V-I, that may have been measured and are being presented to it as arranged in discrete time sequences or frames, to compute an instance of adapted_Z. Now, to verify this instance of adapted_Z, it is used together with the latest current I' to predict the speaker voltage (in block 26). The error between this predicted voltage and the latest voltage V' is then used to adjust the normal adaptation process, but only if the speaker voltage V' is above a threshold. In one embodiment, as depicted in FIG. 5, a band-passed version of the error is generated, using a band pass filter (BPF) 28 that may be centered at about a resonant frequency of the speaker 15. The band pass filter 28 and the resonant frequency used for its passband may have been determined in advance during manufacturing test, or they be updated during in-the-field self testing.

The adapted_Z is depicted as being provided by a selector whose inputs include 1) a normal adapting Z computed by block 24, and 2) a decaying_Z computed using the physical temperature model 29. The selection between these two is informed in decision block 30, based on a comparison between the monitored speaker voltage V (or V') and a threshold, as described more fully above. The decaying_Z may be computed as described above, using a previously determined and stored physical thermal model 29 which models the thermal decay of the speaker 15 (as integrated into its particular user audio device).

In another embodiment, referring back to FIG. 3 now, when the audio signal is detected to be quite narrow band or in essence like a tone (block 23), certain parameters of the speaker thermal model 17 are disabled, or their updates are frozen, until the audio signal resumes a more normal "wide band" form.

As explained above, an embodiment of the invention may be a machine-readable medium (such as microelectronic memory) having stored thereon instructions, which program one or more data processing components (generically referred to here as a "processor") to perform digital audio processing and a thermal control algorithm as described above, including the operations specified for the thermal control module 10. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, in one embodiment, the gain stage 12_N attenuates its input audio signal by applying a scaling factor directly to the input audio discrete time sequence, that is in the time domain; an alternative may be to apply the scaling factor only to a specific sub-band, that is in the frequency domain, of the input audio sequence. The description is thus to be regarded as illustrative instead of limiting.

What is claimed is:

1. A method for controlling an audio signal that is driving a speaker, comprising:

computing a speaker impedance estimate that estimates an electrical impedance of a speaker, wherein the impedance estimate changes while the speaker is being driven by the audio signal, by monitoring voltage of the speaker while the speaker is being driven by the audio signal, while the monitored speaker voltage is greater than a threshold, the impedance estimate is computed using a first methodology that results in the computed impedance estimate responding at a first rate to changes in the monitored voltage and when the monitored speaker voltage drops below the threshold, the impedance estimate is computed using a second methodology that results in the computed impedance estimate responding at a second rate to changes in the monitored voltage, wherein the second rate is slower than the first rate;

computing a temperature estimate using a speaker thermal model, as a function of the audio signal that is driving the speaker and the computed impedance estimate;

computing gain as a function of the temperature estimate; and attenuating the audio signal in accordance with the gain.

2. The method of claim 1 wherein using the second methodology results in the computed impedance estimate responding at the second rate to changes in the monitored voltage so that a rate of change of the computed impedance estimate is similar to a rate at which the speaker cools when the monitored speaker voltage is below the threshold.

3. The method of claim 1 wherein so long as the monitored speaker voltage remains below the threshold, and the impedance estimate is being computed using the second methodology, the computed impedance estimate decays until it reaches an ambient impedance, wherein the ambient impedance is the impedance of the speaker at ambient temperature.

4. The method of claim 3 wherein the speaker thermal model has an input parameter that represents the ambient impedance.

5. The method of claim 1 wherein so long as the monitored speaker voltage remains below the threshold, and the impedance estimate is being computed using the second methodology, the computed impedance estimate decays at a rate similar to the rate at which the speaker cools.

6. The method of claim 2 wherein when the monitored speaker voltage starts to rise above the threshold, the impedance estimate returns to being computed using the first methodology.

7. The method of claim 1 wherein the speaker impedance estimate is computed as a function of real-time speaker voltage and real-time speaker current.

8. The method of claim 1 further comprising:

detecting that the audio signal is narrow band and in response one of disabling and freezing a parameter of the speaker thermal model, as the model is being used for computing the temperature estimate.

9. The method of claim 1 wherein the computed speaker impedance estimates DC resistance of the speaker.

10. The method of claim 1 wherein the computed gain is a vector having a plurality of gain components each for a different frequency band.

11. An audio device comprising:

a speaker;

a variable attenuator to attenuate an audio signal that is to drive the speaker;

a speaker monitor circuit to measure drive voltage of the speaker;

a processor; and program storage in which a thermal control software module is stored that when executed by the processor computes an estimate of a temperature of the speaker, based on the audio signal, computes a gain setting of the attenuator, and computes an adapted impedance of the speaker and uses the adapted impedance to compute the temperature estimate, wherein the adapted impedance is obtained from a normal adaptation process when a measured drive voltage of the speaker is above a threshold, and a decay process when the measured drive voltage is below the threshold, and while the measured drive voltage is greater than a threshold, the adapted impedance is computed by the normal adaptation process using a first methodology that results in the computed adapted impedance responding at a first rate to changes in the measured drive voltage, and when the measured drive voltage drops below the threshold, the adapted impedance starts to be computed by the decay process using a second methodology at results in the computed adapted impedance responding at a second rate to changes in the measured drive voltage, wherein the second rate is slower than the first rate.

12. The audio device of claim 11 wherein using the second methodology results in the computed adapted impedance responding at the second rate to changes in the measured drive voltage so that a rate of change of the computed impedance is similar to a rate at which the speaker cools when the monitored speaker voltage is below the threshold.

13. The audio device of claim 12 wherein so long as the measured drive voltage remains below the threshold, and the adapted impedance is being computed using the second methodology, the adapted impedance decays until it reaches an ambient impedance, wherein the ambient impedance is the impedance of the speaker at ambient temperature.

14. An apparatus for controlling an audio signal that is driving a speaker, comprising:

means for computing a speaker impedance estimate that estimates an electrical impedance of a speaker, wherein the impedance estimate changes while the speaker is being driven by the audio signal, wherein the means for computing a speaker impedance estimate comprises means for monitoring voltage of the speaker while the speaker is being driven by the audio signal, wherein while the monitored speaker voltage is greater than a threshold, the speaker impedance estimate computing means uses a normal adaptation process that uses a first methodology that results in the computed impedance estimate responding at a first rate to changes in the monitored voltage, and when the monitored speaker voltage drops below the threshold, the impedance estimate starts to be computed using a decay process that uses a second methodology that results in the computed impedance estimate responding at a second rate to changes in the monitored voltage, wherein the second rate is slower than the first rate;

means for computing a temperature estimate using a speaker thermal model, as a function of the audio signal that is driving the speaker and the impedance estimate;

means for computing gain as a function of the temperature estimate; and means for attenuating the audio signal in accordance with the gain.

15. The apparatus of claim 14 wherein using the second methodology results in the computed impedance estimate responding to changes in the monitored voltage at a rate that is similar to a rate at which the speaker cools when the monitored speaker voltage is below the threshold.

16. The apparatus of claim 15 wherein so long as the monitored speaker voltage remains below the threshold, and the impedance estimate is being computed using the second methodology, the computed impedance estimate decays until it reaches an ambient impedance, wherein the ambient impedance is the impedance of the speaker at ambient temperature.

17. The apparatus of claim 16 wherein the speaker thermal model has an input parameter that represents the ambient impedance.

18. The apparatus of claim 15 wherein the speaker impedance estimate computing means causes the computed impedance estimate to decay at a rate similar to the rate at which the speaker cools, so long as the monitored speaker voltage remains below the threshold, and the impedance estimate is being computed using the second methodology.

19. The apparatus of claim 15 wherein the speaker impedance estimate computing means resumes with computing the impedance estimate using the first methodology, when the monitored speaker voltage starts to rise above the threshold.

* * * * *